US007314696B2

(12) United States Patent
Fields et al.

(10) Patent No.: US 7,314,696 B2
(45) Date of Patent: Jan. 1, 2008

(54) ELECTROPHOTOGRAPHIC TONER AND DEVELOPMENT PROCESS WITH IMPROVED CHARGE TO MASS STABILITY

(75) Inventors: Robert D. Fields, Rochester, NY (US); Patrick M. Lambert, Rochester, NY (US); Dinesh Tyagi, Fairport, NY (US); James H. Anderson, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/880,689

(22) Filed: Jun. 13, 2001

(65) Prior Publication Data

US 2003/0027068 A1 Feb. 6, 2003

(51) Int. Cl.
*G03G 9/087* (2006.01)
*G03G 9/097* (2006.01)

(52) U.S. Cl. ..... 430/108.3; 430/108.7; 430/109.3; 430/111.33; 430/111.41

(58) Field of Classification Search ..... 430/111.4, 430/111.41, 45, 107.1, 137.14, 137.17, 108.6, 430/108.7, 108.3, 109.3, 111.33, 109, 110, 430/111, 45.1, 45.5
See application file for complete search history.

(56) References Cited

U.S. PATENT DOCUMENTS

| | | | | |
|---|---|---|---|---|
| 2,229,513 | A | 1/1941 | Lustig | |
| 3,565,805 | A | 2/1971 | Jones et al. | |
| 3,694,359 | A | 9/1972 | Merrill et al. | |
| 3,716,630 | A | 2/1973 | Shirk | |
| 3,893,935 | A | 7/1975 | Jadwin et al. | |
| 3,941,898 | A | 3/1976 | Sadamatsu et al. | |
| 3,983,992 | A | 10/1976 | Gray et al. | |
| 4,046,990 | A | 9/1977 | White | 219/471 |
| 4,076,857 | A | 2/1978 | Kasper et al. | |
| 4,079,014 | A | 3/1978 | Burness et al. | |
| 4,085,702 | A | 4/1978 | Consaul et al. | |
| 4,160,644 | A | 7/1979 | Ryan | |
| 4,299,903 | A | 11/1981 | AuClair et al. | |
| 4,323,634 | A | 4/1982 | Jadwin | |
| RE31,072 | E | 11/1982 | Jadwin et al. | 430/99 |
| 4,385,823 | A | 5/1983 | Kasper et al. | 430/60 |
| 4,394,430 | A | 7/1983 | Jadwin et al. | |
| 4,395,109 | A | 7/1983 | Nakajima et al. | |
| 4,414,152 | A | 11/1983 | Santilli et al. | |
| 4,416,965 | A | 11/1983 | Sandhu et al. | |
| 4,473,029 | A | 9/1984 | Fritz et al. | 430/122 |
| 4,515,884 | A | 5/1985 | Field et al. | |
| 4,546,060 | A | 10/1985 | Miskinis et al. | |
| 4,624,907 | A | 11/1986 | Niimura et al. | |
| 4,683,188 | A | 7/1987 | Suzuki et al. | |
| 4,780,553 | A | 10/1988 | Suzuki et al. | |
| 4,810,858 | A | 3/1989 | Urban et al. | |
| 4,814,250 | A | 3/1989 | Kwarta et al. | |
| 4,840,864 | A | 6/1989 | Bugner et al. | |
| 4,843,920 | A | 7/1989 | Hayasaki et al. | |
| 4,853,311 | A * | 8/1989 | Tavernier et al. | 430/109.3 |
| 4,912,009 | A | 3/1990 | Amering et al. | |
| 4,985,328 | A | 1/1991 | Kumagai et al. | |
| 5,057,392 | A | 10/1991 | McCabe et al. | |
| 5,066,558 | A | 11/1991 | Hikake et al. | |
| 5,089,547 | A | 2/1992 | McCabe et al. | |
| 5,102,765 | A | 4/1992 | McCabe et al. | |
| 5,102,769 | A * | 4/1992 | Creatura | 430/111.34 |
| 5,112,715 | A | 5/1992 | DeMejo et al. | |
| 5,147,747 | A | 9/1992 | Wilson et al. | |
| 5,219,694 | A | 6/1993 | Anno et al. | |
| 5,230,978 | A * | 7/1993 | Kawasaki et al. | 430/109.3 |
| 5,364,720 | A * | 11/1994 | Nakazawa et al. | 430/108.7 |
| 5,376,492 | A | 12/1994 | Stelter et al. | 430/122 |
| 5,394,230 | A | 2/1995 | Kaukeinen et al. | 430/42 |
| 5,409,791 | A | 4/1995 | Kaukeinen et al. | 430/54 |
| 5,422,214 | A * | 6/1995 | Akiyama et al. | 430/108.7 |
| 5,482,812 | A * | 1/1996 | Hopper et al. | 430/137.14 |
| 5,489,975 | A | 2/1996 | Kaukeinen et al. | |
| 5,500,320 | A * | 3/1996 | Saha | 430/111.33 |
| 5,534,347 | A | 7/1996 | Chen et al. | 428/375 |
| 5,543,259 | A * | 8/1996 | Schwarz et al. | 430/115 |
| 5,595,823 | A | 1/1997 | Chen et al. | 428/421 |

(Continued)

FOREIGN PATENT DOCUMENTS

EP 0 488 742 A1 6/1992

(Continued)

OTHER PUBLICATIONS

Diamond, A.S., ed. *Handbook of Imaging Materials*, Marcel Dekker, Inc., NY (1991), p. 169, 1991.*

(Continued)

*Primary Examiner*—Janis L. Dote
(74) *Attorney, Agent, or Firm*—Carl F. Ruoff

(57) ABSTRACT

Toners and developers are disclosed. The toner of the present invention contains at least one toner resin, at least one charge control agent, at least one surface treatment agent, and optionally at least one release agent and/or colorant. The toners of the present invention have excellent triboelectric stability over a wide range of temperatures and relative humidity environmental conditions. Further, the toners of the present invention have excellent charge to mass stability over long periods of time. Development systems and methods for developing electrostatic images with toner are further disclosed.

31 Claims, 8 Drawing Sheets

U.S. PATENT DOCUMENTS

| | | | | |
|---|---|---|---|---|
| 5,606,404 | A | 2/1997 | Hilbert et al. | 399/267 |
| 5,629,061 | A | 5/1997 | Kass | 428/35.8 |
| 5,707,772 | A * | 1/1998 | Akimoto et al. | 430/108.8 |
| 5,709,975 | A * | 1/1998 | Yoerger et al. | 430/111.33 |
| 5,744,274 | A * | 4/1998 | Wilson et al. | 430/108.21 |
| 5,780,195 | A | 7/1998 | Nava | |
| 5,840,457 | A * | 11/1998 | Urawa et al. | 430/110.3 |
| 5,863,692 | A * | 1/1999 | Nakamura et al. | 430/108.4 |
| 5,922,822 | A * | 7/1999 | Wilson et al. | 526/268 |
| 5,985,499 | A | 11/1999 | Guth et al. | 430/42 |
| 5,990,332 | A * | 11/1999 | Sukata et al. | 430/108.3 |
| 6,067,438 | A | 5/2000 | Chen et al. | 399/325 |
| 6,074,795 | A * | 6/2000 | Watanabe et al. | 430/111.4 |
| 6,096,429 | A | 8/2000 | Chen et al. | 428/421 |
| 6,103,439 | A * | 8/2000 | Ogawa et al. | 430/110.3 |
| 6,197,466 | B1 | 3/2001 | Fields et al. | |
| 6,221,550 | B1 * | 4/2001 | Wilson et al. | 430/108.2 |
| 6,416,920 | B1 * | 7/2002 | Hopper et al. | 430/137.14 |
| 6,692,880 | B2 * | 2/2004 | Fields | 430/108.1 |

FOREIGN PATENT DOCUMENTS

| | | |
|---|---|---|
| GB | 1117224 | 6/1968 |
| GB | 1420830 | 1/1976 |
| GB | 1501065 | 2/1978 |
| JP | 63-34551 | 2/1988 |
| JP | 63-155156 | 6/1988 |

OTHER PUBLICATIONS

Gerhartz, W., et al., ed. *Ulmann's Encyclopedia of Industrial Chemistry*, Fifth Rev. Edition, VCH Verlags Gesellschaft MbH, D-6940 Weinheim, Copyright © 1986, vol. A7, p. 341.*

U.S. Appl. No. 60/290,707.*

ACS File Registry No. 60806-47-5, copyright 2005 ACS on STN.*

KODAK Material Safety Data Sheet for product SB77XL DRY, revised on Dec. 8, 2004.*

ACS File Registry No. 7631-86-9, entered STN on Nov. 16, 1984, copyright 2006 ACS on STN.*

Partial European Search Report, Sep. 27, 2002.

Database WPI—Derwent Publications XP-002214991, JP 1994-068919 (1994).

* cited by examiner

ELECTROPHOTOGRAPHIC TONER AND DEVELOPMENT PROCESS WITH IMPROVED CHARGE TO MASS STABILITY

BACKGROUND OF THE INVENTION

The present invention relates to toners and development systems for toners. More particularly, the present invention relates to electrophotographic toners and developers which have superior electrophotographic stability especially with respect to small charge to mass variability over a wide range of temperatures and relative humidity environmental conditions.

Digital printers and similar products can exhibit undesirable humidity sensitivity and temperature sensitivity which affects the image quality of the image. In more detail, the sensitivity generally takes the form of the developer charge per mass increasing with increasing relative humidity. This particular problem can be seen, for instance, with respect to the initial start up of a copier. When a copier is running, typically the interior of the toning station can be about 20° F. hotter than ambient air, due to various sources of heat including the fuser and the toner station itself. This temperature rise results in effectively lowering the relative humidity seen by the developer to about half of that of the ambient air. Thus, the developer is running at a lower charge per mass value. During an overnight period, when the copier is off, the developer can generally become equilibrated with the higher humidity outside air, but it cannot change its value of charge until it is agitated by starting the use of a copier. What is then observed upon startup is a rapid increase in the charge of the developer and a drop off in copy density.

The developer charge to mass ratio is a primary factor in determining the amount of toner that is transferred from an electrophotographic developer station, for instance, a hard magnetic based carrier electrophotographic developer station, to the image. The high charged toner will generally deposit less toner than a low charged toner at the same exposed film voltage. Variations in the amount of toner transferred to the film results in variations in the reflection print density of the image. This is particularly noticeable when reproducing half-tone or gray scale images. This variability can be the result of various environmental factors, such as temperature and relative humidity, or time dependent charge rise or decay in the developer mixture. This effect means that process control systems or environmental control systems must be designed and built into a printer to compensate for varying developer charge to mass values. Formulating materials not effected by these various factors can reduce complexity and cost to design and build a printer.

Accordingly, there is a need to provide toners and development systems for toners that provide low charge to mass variation with respect to humidity variations or operation over long periods of time. Unless stated otherwise, all wt % are based on the weight of the toner particles.

SUMMARY OF THE PRESENT INVENTION

A feature of the present invention is to provide a toner which has stable triboelectric charge levels independent of relative humidity and which are very consistent over time.

Another feature of the present invention is to provide a developer which has a stable triboelectric charge level which results in a total charge to mass response which is independent of relative humidity and/or is very consistent over time.

A further feature of the present invention is to provide development systems which results in the toner having stable triboelectric charge levels which are relatively independent of the relative humidity and are very consistent over time.

Additional features and advantages of the present invention will be set forth in part in the description which follows, and in part will be apparent from the description, or may be learned by practice of the present invention. The objectives and other advantages of the present invention will be realized and attained by means of the elements and combinations particularly pointed out in the written description and appended claims.

To achieve these and other advantages and in accordance with the purposes of the present invention, as embodied and broadly described herein, the present invention relates to a toner having at least one toner resin, at least one charge control agent, at least one surface treatment agent, and optionally at least one colorant or release agent or both. The toner resin has inorganic particles distributed in the resin. Preferably, the inorganic particles are silica which are present preferably in low amounts. The toner is preferably a negatively charging toner and thus the charge control agent is preferably a negative charge control agent and more preferably an organo iron complex charge control agent. The resin which contains the inorganic particles is preferably made using a limited coalescence reaction.

The present invention further relates to toners having stable triboelectric charge levels, such that the total charge to mass response is independent of relative humidity and/or is very consistent over time.

In addition, the present invention relates to a developer having the above-mentioned toner in combination with hard magnetic carrier particles which are preferably coated with one or more various resin materials. Preferably, the coating on the carrier particles is a blend of a polyvinylidiene/polymethylmethacrylate resin.

The present invention in addition relates to methods for developing an electrostatic image with the above-described toner. The development system includes a supply of dry developer mixture which contains toner particles and hard magnetic carrier particles. The development system further includes a non-magnetic, cylindrical shell for transporting the developer between the supply and the development zone wherein the shell can be rotatable or stationary. A rotating magnetic core of a pre-selected magnetic field strength and means for rotating at least the magnetic core to provide for the transport of the toner particles from the shell to an electrostatic image are also provided as part of the development system. The development system preferably further includes a fusing roll coated with silicone rubber or other low surface energy elastomers or resins. Preferably, the fusing roll is a filled silicone rubber fusing roller.

The present invention further relates to a method for developing an electrostatic image with the above-described toner. The method involves developing an electrostatic image member bearing an electrostatic image pattern by moving the image member through a development zone and transporting developer through the development zone in developing relation with the charge pattern of the moving imaging member by rotating an alternating-pole magnetic core of a pre-selected magnetic field strength within an outer non-magnetic shell, which can be rotating or stationary, and controlling the directions and speeds of the core and optionally the shell rotations so that developer flows through the development zone in a direction co-current with the image member movement, wherein an electrographic two-component dry developer composition is preferably used. The method further involves transferring the toner to a substrate and the substrate with the toner image is then subsequently fused by passing the toner image on the substrate through a fusing roll to fuse the image on the substrate wherein the fusing roll is preferably a silicone rubber coated fusing roller or is coated with other low surface energy elastomers or resins. The fuser roll is preferably in a pressure contact arrangement with a backup or pressure roll. The dry developer composition contains charged toner particles and oppositely charged carrier particles. Preferably, the carrier particles are a hard magnetic material exhibiting a coercivity of at least about 300 gauss when magnetically saturated and also exhibit an induced magnetic moment of at least about 20 EMU/gm when in an externally applied field of 1,000 gauss. The carrier particles have a sufficient magnetic moment to prevent the carrier particles from transferring to the electrostatic image.

It is to be understood that both the foregoing general description and the following detailed description are exemplary and explanatory only and are intended to provide a further explanation of the present invention, as claimed.

DETAILED DESCRIPTION OF THE PRESENT INVENTION

Figure 1:
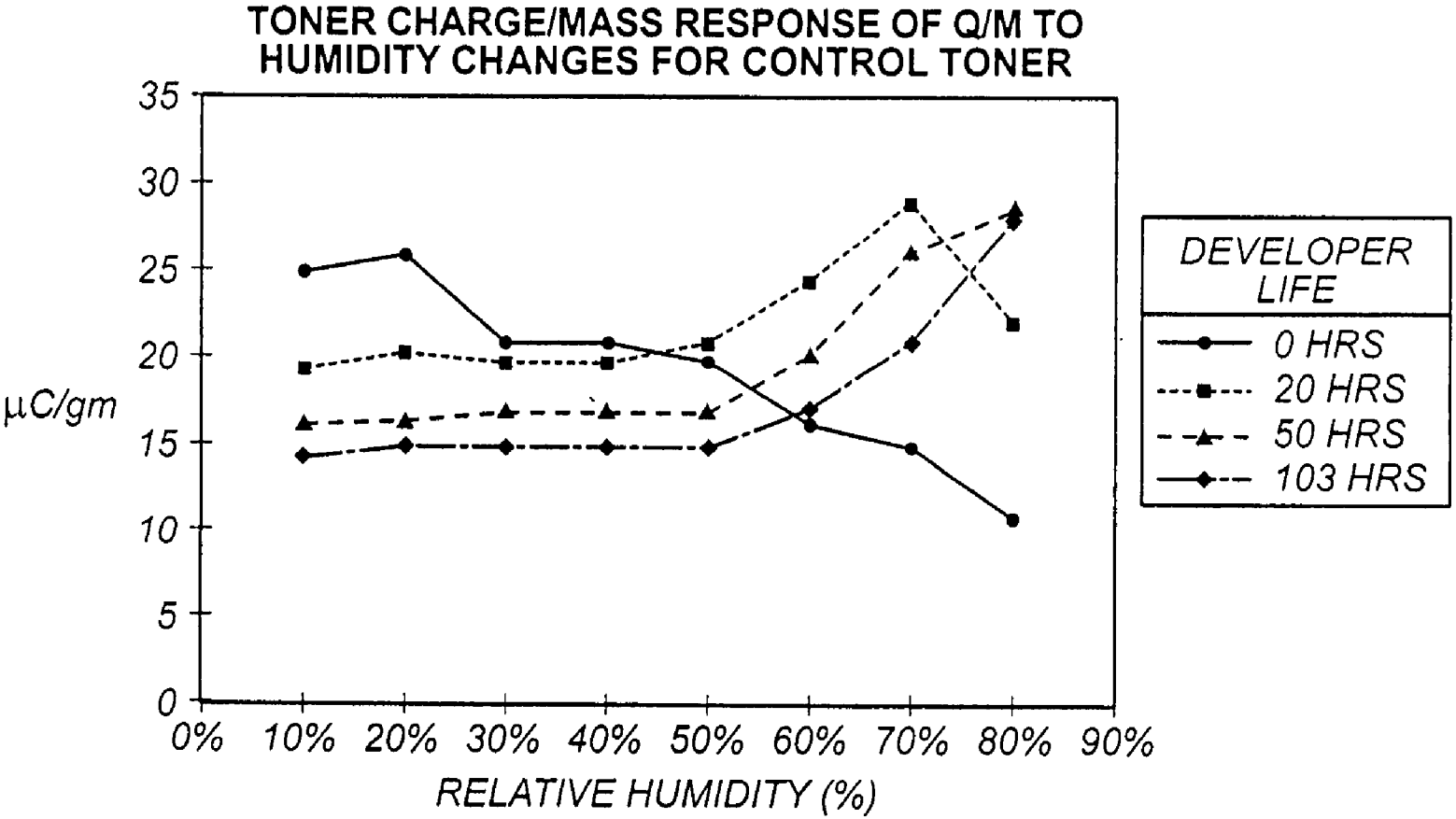
FIG. 1 is a graph comparing charge to mass levels as a function of relative humidity for a control toner.

The present invention relates to development systems and methods for developing using certain types of toners. The present invention further relates to the developer used in the development system as well as the toner in the developer.

In more detail, the present invention, in part, relates to a toner having at least one toner resin, at least one charge control agent, at least one surface treatment agent, and optionally at least one colorant and/or at least one release agent, or both. The resin preferably contains inorganic particles, such as silica distributed in the resin.

The toner particles can include one or more toner resins which can be optionally colored by one or more colorants by compounding the resin(s) with at least one colorant and any other ingredients. Although coloring is optional, normally a colorant is included and can be any of the materials mentioned in *Colour Index*, Volumes I and II, Second Edition, incorporated herein by reference. The toner resin can be selected from a wide variety of materials including both natural and synthetic resins and modified natural resins as disclosed, for example, in U.S. Pat. Nos. 4,076,857; 3,938,992; 3,941,898; 5,057,392; 5,089,547; 5,102,765; 5,112,715; 5,147,747; 5,780,195 and the like, all incorporated herein by reference. Preferred resin or binder materials include polyesters and styrene-acrylic copolymers. The shape of the toner particles can be any shape, regular or irregular, such as spherical particles, which can be obtained by spray-drying a solution of the toner resin in a solvent. Alternatively, spherical particles can be prepared by the polymer bead swelling techniques, such as those described in European Patent No. 3905 published Sep. 5, 1979, which is incorporated in its entirety by reference herein.

Polymeric binders for electrostatographic toners are commonly made by polymerization of selected monomers followed by mixing with various additives and then grinding to a desired size range. During toner manufacturing, the polymeric binder is subjected to melt processing in which the polymer is exposed to moderate to high shearing forces and temperatures in excess of the glass transition temperature of the polymer. The temperature of the polymer melt results, in part, from the frictional forces of the melt processing. The melt processing includes melt-blending of toner addenda into the bulk of the polymer.

The polymer may be made using a limited coalescence reaction such as the suspension polymerization procedure disclosed in U.S. Pat. No. 4,912,009 to Amering et al., which is incorporated in its entirety by reference herein. The resin is preferably present in an amount of from about 80% to about 95 wt % and more preferably about 90 wt %. In the toner resin, inorganic particles are preferably present in the resin. These inorganic particles are preferably uniformly distributed throughout the resin. Preferred inorganic particles are silica. The amount of the inorganic particles present in the resin is an amount from about 0.1 wt % to about 0.5 wt % and more preferably about 0.2 to about 0.3 wt %, based on the weight of the toner. The inorganic particles, preferably silica, are introduced into the resin during the compounding of the resin. The inorganic particles, and preferably the silica are preferably not in a charged state. Further, the silica is preferably colloidal silica.

Useful binder polymers include vinyl polymers, such as homopolymers and copolymers of styrene. Styrene polymers include those containing 40 to 100 percent by weight of styrene, or styrene homologs, and from 0 to 40 percent by weight of one or more lower alkyl acrylates or methacrylates. Other examples include fusible styrene-acrylic copolymers that are covalently lightly cross linked with a divinyl compound such as divinylbenzene. Binders of this type are described, for example, in U.S. Reissue Pat. No. 31,072, which is incorporated in its entirety by reference wherein. Preferred binders comprise styrene and an alkyl acrylate and/or methacrylate and the styrene content of the binder is preferably at least about 60% by weight.

Copolymers rich in styrene such as styrene butylacrylate and styrene butadiene are also useful as binders as are blends of polymers. In such blends, the ratio of styrene butylacrylate to styrene butadiene can be 10:1 to 1:10. Ratios of 5:1 to 1:5 and 7:3 are particularly useful. Polymers of styrene butylacrylate and/or butylmethacrylate (30 to 80% styrene) and styrene butadiene (30 to 80% styrene) are also useful binders.

Styrene polymers include styrene, alpha-methylstyrene, para-chlorostyrene, and vinyl toluene; and alkyl acrylates or methylacrylates or monocarboxylic acids having a double bond selected from acrylic acid, methyl acrylate, 2-ethylhexyl acrylate, 2-ethylhexyl methacrylate, ethyl acrylate, butyl acrylate, dodecyl acrylate, octyl acrylate, phenylacrylate, methylacrylic acid, ethyl methacrylate, butyl methacrylate and octyl methacrylate and are also useful binders. Also useful are condensation polymers such as polyesters and copolyesters of aromatic dicarboxylic acids with one or more aliphatic diols, such as polyesters of isophthalic or terephthalic acid with diols such as ethylene glycol, cyclohexane dimethanol, and bisphenols.

A useful binder can also be formed from a copolymer of a vinyl aromatic monomer; a second monomer selected from either conjugated diene monomers or acrylate monomers such as alkyl acrylate and alkyl methacrylate. A preferred toner resin is a crosslinked styrene acrylate copolymer.

The term "charge-control" refers to a propensity of a toner addendum to modify the triboelectric charging properties of the resulting toner. A very wide variety of optional charge control agents for positive and negative charging toners are available and can be used in the toners of the present invention. Suitable charge control agents are disclosed, for example, in U.S. Pat. Nos. 3,893,935; 4,079,014; 4,323,634; 4,394,430; and British Patent Nos. 1,501,065 and 1,420,839, all of which are incorporated in their entireties by reference herein. Additional charge control agents which are useful are described in U.S. Pat. Nos. 4,624,907; 4,814,250; 4,840,864; 4,834,920; 4,683,188; and 4,780,553, all of which are incorporated in their entireties by reference herein. Mixtures of charge control agents can also be used. Negative charge control agents are preferred such as organo iron complex charge agents, such as those available from Hodogaya Chemical Co., Ltd. Particular examples of charge control agents include chromium salicylate organo-complex salts, and azo-iron complex-salts, an azo-iron complex-salt, particularly ferrate (1-), bis[4-[(5-chloro-2-hydroxyphenyl) azo]-3-hydroxy-N-phenyl-2-naphthalenecarboxamidato (2-)], ammonium, sodium, and hydrogen (Organoiron available from Hodogaya Chemical Company Ltd.). The charge control agent is present in an amount of from about 1 wt % to about 2.5 wt % and more preferably about 1.8 wt %.

The surface treatment with a surface treatment agent or a spacing agent preferably reduces the attraction between the toner particles and magnetic carrier particles, such as the hard magnetic carrier particles to a degree sufficient that the toner particles are transported by the carrier particles to the development zone where the electrostatic image is present and then the toner particles leave the carrier particles due at least in part to the sufficient electrostatic forces associated with the charged image. Accordingly, the preferred toner particles of the present invention permit attraction with the magnetic carrier particles but further permit the stripping of the toner particles from the hard magnetic carrier particles by the electrostatic andlor mechanical forces and with surface treatment on the toner particles. In other words, the spacing agent on the surface of the toner particles, as indicated above, is sufficient to reduce the attraction between the toner particles and the hard magnetic carrier particles such that the toner particles can be stripped from the carrier particles by the electrostatic forces associated with the charged image or by mechanical forces.

The preferred spacing agent is silica, such as those commercially available from Degussa, like R-972, or from Wacker, like H2000. Other suitable spacing agents include, but are not limited to, other inorganic oxide particles and the like. Specific examples include, but are not limited to, titania, alumina, zirconia, and other metal oxides; and also polymer beads preferably less than 1 μm in diameter (more preferably about 0.1 μm), such as acrylic polymers, silicone-based polymers, styrenic polymers, fluoropolymers, copolymers thereof, and mixtures thereof.

The amount of the spacing agent on the toner particles is an amount sufficient to permit the toner particles to be stripped from the magnetic carrier particles by the electrostatic forces associated with the charged image or by mechanical forces. Preferred amounts of the spacing agent are from about 0.05 to about 5.0 wt %, and more preferably from about 0.1 to about 1.0 wt %, and most preferably from about 0.2 to about 0.6 wt %, based on the weight of the toner. The size of the spacing agent is preferably greater than a BET size of about 35 $m^2/g$, and more preferably about 100 $m^2/g$ to about 400 $m^2/g$, or higher. Other amounts outside of these ranges can be used.

The spacing agent can be applied onto the surfaces of toner particles by conventional surface treatment techniques such as, but not limited to, conventional mixing techniques, such as tumbling the toner particles in the presence of the spacing agent. Preferably, the spacing agent is distributed on the surface of the toner particles. The spacing agent is attached onto the surface of the toner particles and can be attached by electrostatic forces or physical means or both. With mixing, preferably uniform mixing is preferred and achieved by such mixers as a high energy Henschel-type mixer which is sufficient to keep the spacing agent from agglomerating or at least minimizes agglomeration. Furthermore, when the spacing agent is mixed with the magnetic toner particles in order to achieve distribution on the surface of the toner particles, the mixture can be sieved to remove any agglomerated spacing agent. Other means to separate agglomerated particles can also be used for purposes of the present invention.

In the present invention, at least one release agent is preferably present in the toner formulation. An example of a suitable release agent is one or more waxes. Useful release agents are well known in this art. Useful release agents include low molecular weight polypropylene, natural waxes, low molecular weight synthetic polymer waxes, commonly accepted release agents, such as stearic acid and salts thereof, and others.

The wax is preferably present in an amount of from about 0.1 to about 10 wt % and more preferably in an amount of from about 0.5 to about 5 wt % based on the toner weight, and more preferably about 1.8 wt %. Examples of suitable waxes include, but are not limited to, polyolefm waxes, such as low molecular weight polyethylene, polypropylene, copolymers thereof and mixtures thereof. In more detail, more specific examples are copolymers of ethylene and propylene preferably having a molecular weight of from about 1000 to about 5000 g/mole, particularly a copolymer of ethylene and propylene having a molecular weight of about 1200 g/mole. Additional examples include synthetic low molecular weight polypropylene waxes preferably having a molecular weight from about 3,000 to about 15,000 g/mole, such as a polypropylene wax having a molecular weight of about 4000 g/mole. Other suitable waxes are synthetic polyethylene waxes. Suitable waxes are waxes available from Mitsui Petrochemical, Baker Petrolite, such as POLYWAX 2000, POLYWAX 3000, and/or UNICID 700; and waxes from Sanyo Chemical Industries such as VISCOL 550P and/or VISCOL 660P. Other examples of suitable waxes include waxes such as LICO WAX PE130 from Clariant Corporation.

The development system of the present invention preferably contains a supply of dry, developer mixture which includes toner and magnetic carrier particles, such as hard magnetic carrier particles. The toner is preferably present in an amount of from about 5 wt % to about 15 wt %, and preferably about 10 wt % based on the weight of the developer.

A non-magnetic, cylindrical shell which can be a stationary shell or a rotating shell is preferably used for transporting the developer mixture from the supply to the development zone. A magnetic core which includes a plurality of magnetic pole portions is arranged around the core periphery in alternating magnetic polarity relation and which is rotatable on an axis within the non-magnetic, cylindrical shell. Furthermore, means for rotating the core and optionally the shell are present in order to deliver the developer mixture to the development zone wherein the toner of the developer is transferred to the electrostatic image.

The development system of the present invention preferably further includes a fuser roll which is optimally coated with a silicone rubber or other low surface energy elastomer or resin. The fuser roll is preferably in a pressure contact arrangement with a backup or pressure roll. In this assembly, both the fuser roll and the pressure roll are pressed against each other under sufficient pressure to form a nip. It is in this nip that the fusing or fixing takes place. The use of these toner particles in combination with the particular development system described herein results in an image which has improved image quality along with excellent fusing quality.

The set up of the development system is preferably a digital printer, such as a Heidelberg DIGIMASTER 9110 printer using a development station comprising a non-magnetic, cylindrical shell, a magnetic core, and means for rotating the core and optionally the shell as described, for instance, in detail in U.S. Pat. Nos. 4,473,029 and 4,546,060, both incorporated in their entirety herein by reference. The development systems described in these patents can be adapted for use in the present invention. In more detail, the development systems described in these patents preferably use hard magnetic carrier particles. For instance, the hard magnetic carrier particles can exhibit a coercivity of at least about 300 gauss when magnetically saturated and also exhibit an induced magnetic moment of at least about 20 EMU/gm when in an externally applied field of 1,000 gauss. The magnetic carrier particles can be binder-less carriers or composite carriers. Useful hard magnetic materials include ferrites and gamma ferric oxide. Preferably, the carrier particles are composed of ferrites, which are compounds of magnetic oxides containing iron as a major metallic component. For example, compounds of ferric oxide, $Fe_2O_3$, formed with basic metallic oxides such as those having the general formula $MFeO_2$ or $MFe_2O_4$ wherein M represents a mono- or di-valent metal and the iron is in the oxidation state of +3. Preferred ferrites are those containing barium and/or strontium, such as $BaFe_{12}O_{19}$, $SrFe_{12}O_{19}$, and the magnetic ferrites having the formula $MO.6\ Fe_2O_3$, wherein M is barium, strontium, or lead as disclosed in U.S. Pat. No. 3,716,630 which is incorporated in its entirety by reference herein. The size of the magnetic carrier particles useful in the present invention can vary widely, and preferably have an average particle size of less than 100 microns, and more preferably have an average carrier particle size of from about 5 to about 45 microns.

An optional additive for the toner is a colorant. In some cases the magnetic component, if present, acts as a colorant negating the need for a separate colorant. Suitable dyes and pigments are disclosed, for example, in U.S. Reissue Pat. No. 31,072 and in U.S. Pat. Nos. 4,160,644; 4,416,965; 4,414,152; and 2,229,513, all incorporated in their entireties by reference herein. One particularly useful colorant for toners to be used in black and white electrostatographic copying machines and printers is carbon black. Colorants are generally employed in the range of from about 1 to about 30 weight percent on a total toner powder weight basis, and preferably in the range of about 2 to about 15 weight percent. The toner formulations can also contain other additives of the type used in conventional toners, including magnetic pigments, colorants, leveling agents, surfactants, stabilizers, and the like.

The remaining components of toner particles as well as the hard magnetic carrier particles can be conventional ingredients. For instance, various resin materials can be optionally used as a coating on the hard magnetic carrier particles, such as fluorocarbon polymers like poly (tetrafluoro ethylene), poly(vinylidene fluoride) and polyvinylidene fluoride-co-tetrafluoroethlyene). Examples of suitable resin materials for the carrier particles include, but are not limited to, silicone resin, fluoropolymers, polyacrylics, polymethacrylics, copolymers thereof, and mixtures thereof, other commercially available coated carriers, and the like. A preferred polymer coating for the carrier particles is a polyvinylidiene resin, polymethylmethacrylate, or blends thereof. Preferably, the blend is from about 80/20 wt % to 20/80 wt % of the polyvinylidiene to polymethylmethacrylate. More preferred blend ratios are 60/40 wt %; 50/50 wt %; and 40/60 wt % ratios of the polyvinylidiene to polymethylmethacrylate.

The present invention further relates to methods of forming images using the toners and developers of the present invention. Generally, the method includes forming an electrostatic latent image on a surface of an electrophotographic element and developing the image by contacting the latent image with the toner/developer of the present invention.

The present invention further relates to the use of the above-described development system in developing electrostatic images with the toner of the present invention. The method involves contacting an electrostatic image with the toner of the present invention. For example, the method involves developing an electrostatic image member bearing an electrostatic image pattern by moving the image member through a development zone and transporting developer through the development zone in developing relation with the charge pattern of the moving imaging member by rotating an alternating-pole magnetic core of a pre-selected magnetic field strength within an outer non-magnetic shell, which can be rotating or stationary, and controlling the directions and speeds of the core and optionally the shell rotations so that developer flows through the development zone in a direction co-current with the image member movement, wherein an electrographic two-component dry developer composition is preferably used. The dry developer composition contains charged toner particles and oppositely charged carrier particles. The carrier particles are preferably a hard magnetic material exhibiting a coercivity of at least about 300 gauss when magnetically saturated and also exhibit an induced magnetic moment of at least about 20 EMU/gm when in an externally applied field of 1,000 gauss. The carrier particles have a sufficient magnetic moment to prevent the carrier particle from transferring to the electrostatic image. The various methods described in U.S. Pat. Nos. 4,473,029 and 4,546,060 can be used in the present invention using the toner of the present invention in the manners described herein, and these patents are incorporated in their entirety by reference herein.

The electrostatic image so developed can be formed by a number of methods such as by imagewise photodecay of a photoreceptor or imagewise application of a charge pattern on the surface of a dielectric recording element. When photoreceptors are used, such as in high-speed electrophotographic copy devices, the use of half-tone screening to modify an electrostatic image is particularly desirable; the combination of screening with development in accordance with the method of the present invention producing high-quality images exhibiting high Dmax and excellent tonal range. Representative screening methods include those employing photoreceptors with integral half-tone screen, such as those described in U.S. Pat. No. 4,385,823, incorporated in its entirety by reference herein.

The development system of the present invention further includes a fuser roll which is preferably coated with a silicone rubber or other low surface energy elastomer or resin such as tetrafluoroethylene resin. The silicone rubbers which can be used as the surface of the fuser member can be a room temperature vulcanization silicone rubber, a low temperature vulcanization silicone rubber, or a high temperature vulcanization type silicone rubber. The fuser roll can be any shape such as a plate or belt but is preferably cylindrical. Preferably, the fuser roll is composed of a core having coated thereon a thin layer of a silicone rubber. The core may be made of various metals such as iron, aluminum, nickel, stainless steel, and the like or other resilient materials such as various synthetic resins. The core is preferably hollow and a heating element is generally positioned inside the hollow core to supply the heat for the fusing operation. Heating elements suitable for this purpose are known to those skilled in the art and may be a quartz heater made of a quartz envelope having a tungsten resistant heating element disposed internally thereof. The method of providing the necessary heat in the fuser roll is not critical to the present invention and the fuser member can be heated by internal means, external means, or a combination of both. All heating means are well known to those skilled in the art for providing sufficient heat to fuse the toner to the support. The fuser roll is preferably in a pressure contact arrangement with a backup or pressure roll. The pressure roll preferably is a metal core with a layer of a heat-resistant material. In this assembly, both the fuser roll and the pressure roll are mounted on shafts which are biased so that the fuser roll and pressure roll are pressed against each other under sufficient pressure to form a nip. It is in this nip that the fusing or fixing takes place. The quality of the copies produced by the fuser assembly is better when the nip is formed by a relatively hard and unyielding layer with a relatively flexible layer. In this manner, the nip is formed by a slight deformation in the layer due to the biasing of the fuser roll and the pressure roll. The relatively hard and unyielding layer may be made of any well known material such as polyfluoroethylene, propylene, or a silicone rubber, or other similar materials. In the present invention, the fusing occurs when a sheet of a support material such as a sheet of paper bearing thereon a toner image passes between the fuser roll and the pressure roll. The fuser roll then fuses the toner image onto the support material thus forming a printed image on the substrate. With the above-described development system using the particular fuser assembly described herein along with the particular toner formulations described herein, excellent image quality along with good fusing quality is accomplished with respect to the printed image. The present invention provides a means to accomplish a balancing of properties, namely image quality with fusing quality and in a system that provides high speed digital copying in a two component system. The fuser assembly that can be used in the present invention in combination with the particular toner formulations described herein as well as the development system are described in detail in, for instance, U.S. Pat. Nos. 5,534,347, 5,629,061, 3,938,992, 4,046,990, 4,085,702, RE 31,072, 4,810,858, 4,395,109, 6,096,429, 6,067,438, 4,515,884, and 5,595,823. All of these patents are incorporated in their entirety by reference herein.

The various options described in these patents such as the use of a particular silicone rubber or other optional components such as the use of silicone or siloxane oil can be incorporated into the present invention.

The toners and developers of the present invention have stable triboelectric charge levels which preferably are achieved by balancing the effects of the individual toner components as set forth above. The total charge to mass response of the toner of the present invention as, for instance shown in the examples, is independent of the relative humidity and/or is very consistent over time. In more detail, with conventional toners, the charge to mass response as a result of humidity changes is affected over various developer ages (i.e., over time). The charge/mass level as humidity increased showed a decrease. On the other hand, "aged" developer showed an increase in charge after various hours of operation. Irrespective of humidity, the charge to mass level is also affected in conventional toners as the developer is operated over time (such as over 100 hours of use). On the other hand, the toners of the present invention have consistent charge to mass levels even when there were variations in humidity. These consistent charge to mass levels were also maintained over a period of time. Thus, the toners of the present invention as well as the developers of the present invention are independent with respect to charge to mass levels in varying degrees of humidity and over time. Furthermore, the toners of the present invention provide an excellent charge rate in that the charging of the toner is fast.

With respect to the charging rate, the toners and developers of the present invention have an excellent charging rate. In more detail, the toners of the present invention reach a desirable charge level in a short amount of time and further maintain this desirable charge level over a period of time. One way to quantify this desirable property is with respect to a MECCA test which involves determining the level of charge obtained in 2 minutes of charging and determining the level of charge after 10 minutes wherein the 10 minute measurement is viewed as a equilibrium reached typically by the toner. Generally, for purposes of the present invention, a preferred toner is a toner that has a 2 minute charge level that is similar to the 10 minute charge level. In other words, preferably, the charge ratio of 2 minutes/10 minutes is from about 0.9 to about 1.1. Preferably, the 2 minute charge level is from about −20 to about −30 μC/gm and more preferably from about −25 to about −27 μC/gm and the 10 minute charge level is also about in the same ranges. Toners having this desirable charge ratio of 2 minutes/10 minutes provide excellent development qualities with respect to the developed image and other benefits.

Developers in the development system of the present invention are preferably capable of delivering toner to a charged image at high rates and hence are particularly suited to high-volume electrophotographic printing applications and copying applications.

The prints resulting from the development process of the present invention have, as stated above, improved image quality in combination with excellent fusing quality. The printed images when fused on a substrate such as a sheet of paper have improved abrasion resistance, reduced "toner ruboff", even when fed in friction fed finishing equipment. Furthermore, the toner fused image reduced crack widths when the paper sheet is folded.

As an alternative embodiment, instead of using a spacing agent on the toner particles, the transfer potential can be significantly increased such that the electrostatic forces associated with the charged image are quite high, such as from about 1,000 volts to about 2,500 so that these electrostatic charges are sufficient to strip the toner particles away from the carrier particles.

Another alternative way of using the development system of the present invention is to increase the speed of the rotating magnetic core which permits the shaking of the toner particles to such an extent that their stripping from the carrier particles is possible. The speed of the rotating core is at least about 100 rpm or at least about 500 rpm. With respect to this embodiment, the speed of the rotating magnetic core is at least about 1,000 rpm and can be at least about 2,000 rpm or at least about 2,500 rpm, and more preferably is from about 500 to about 2,500 rpm. These various embodiments described above can be used in various combinations as well.

An additional alternative way of using the development system of the present invention is to add an AC bias in superposition with the DC bias of the toning station. The AC bias agitates the toner particles so that the stripping of toner particles from carrier particles is enhanced. The AC bias waveform preferably has a frequency of from about 300 Hz to about 3000 Hz and peak-to-peak amplitudes of from about 0.2 kV to about 5 kV; and most preferably range from about 1000 to about 1500 Hz, with a 2-3 kV peak-to-peak. AC voltages having the form of a trapezoidal wave and most preferably a square wave are preferable to waveforms with lower average rms voltage, such as sine waves or triangle waves. The usefulness of AC bias as a means of enhancing image density and reducing undesirable side effects of toning in conjunction with toning stations having a rotating magnetic core is described in U.S. Pat. Nos. 5,376,492; 5,394,230; 5,409,791; 5,489,975; 5,606,404; and 5,985,499. All of the various embodiments described above can be used in various combinations as well.

The present invention can be further clarified by the following examples, which are intended to be purely exemplary of the present invention.

EXAMPLES

A set of developer life tests were conducted on a life test fixture. The life test fixture comprises a toning station similar to that disclosed in U.S. Pat. No. 4,473,029, the teachings of which are incorporated herein in the entirety by reference. The toning station has a mixing sump with magnetic toner concentration monitor, feed mechanism (transport roller or bucket brigade plus feed skive), rotating core and shell toning roller, and toner replenishment unit. Toner is taken out continuously by bias development onto a metal drum, from which it is removed by a blade cleaning mechanism. As toner is depleted from the station, the magnetic monitor and control circuitry add replenisher toner such that the toner concentration in the sump is held constant. The rate of takeout is controlled by the bias development voltage. Charge per mass is measured off-line by MECCA method as described hereinafter.

The test samples that are measured are prepared by exercising the developer with rotating magnets to create a magnetic field that results in the physical mixing of the particles causing the particles to charge for a period of 2 minutes and then 8 additional minutes. The toner Q/m ratio can be measured in a MECCA device comprised of two spaced-apart, parallel, electrode plates which can apply both an electrical and magnetic field to the developer samples, thereby causing a separation of the two components of the mixture, i.e., carrier and toner particles, under the combined influence of a magnetic and electric field. A 0.100 g sample of a developer mixture is placed on the bottom metal plate. The sample is then subjected for thirty (30) seconds to a 60 Hz magnetic field and potential of 2000 V across the plates, which causes developer agitation. The toner particles are released from the carrier particles under the combined influence of the magnetic and electric fields and are attracted to and thereby deposit on the upper electrode plate, while the magnetic carrier particles are held on the lower plate. An electrometer measures the accumulated charge of the toner on the upper plate. The toner Q/m ratio in terms of microcoulombs per gram (μC/g) is calculated by dividing the accumulated charge by the mass of the deposited toner taken from the upper plate.

Example 1

A toner formulation was made from the following components:

TABLE 1

| Chemical | Trade name | Manufacturer | Weight % |
|---|---|---|---|
| Crosslinked styrene butyl acrylate copolymer | SB77XL | Eastman Kodak | 90% |
| Carbon Black | BLACK PEARLS 430 | Cabot Corp | 6.4% |
| Polyethylene wax | LICOWAX PE130 | Clariant Corporation | 1.8% |
| Iron organic chelate charge control agent | T77 | Hodogaya | 1.8% |

The components were dry powder blended in a 40 liter Henschel mixer for 60 seconds at 1000 RPM to produce a homogeneous blend.

The powder blend was then melt compounded in a twin screw co-rotating extruder to melt the polymer binder and disperse the pigments, charge agents, and waxes. Melt compounding was done at a temperature of 230° F. at the extruder inlet, 230° F. increasing to 385° F. in the extruder compounding zones, and 385° F. at the extruder die outlet. The processing conditions were a powder blend feed rate of 10 kg/hr and an extruder screw speed of 490 RPM. The cooled extrudate was then chopped to approximately ⅛ inch size granules.

After melt compounding, the granules were then fine ground in an air jet mill to a particle size of 11 micron median, volume weighted, diameter. The toner particle size distribution was measured with a Coulter Counter Multisizer. The fine ground toner was then classified in a centrifugal air classifier to remove very small toner particles and toner fines that were not desired in the finished toner. After classification to remove fine particles, the toner had a particle size distribution with a width, expressed as the diameter at the 50% percentile/diameter at the 16% percentile of the cumulative particle number versus particle diameter, of 1.30 to 1.35.

The classified toner was then surface treated with fumed silica. A hydrophobic silica, designated R972, and manufactured by Nippon Aerosil was used. 2000 grams of toner were mixed with 4 grams of silica to give a product containing 0.2 weight percent silica. The toner and silica were mixed in a 10 liter Henschel mixer with a 4 element impeller for 2 minutes at 2000 RPM.

The silica surface treated toner was sieved through a 230 mesh vibratory sieve to remove un-dispersed silica agglomerates and any toner flakes that may have formed during the surface treatment process.

(field~4 kilogauss). The resulting magnetized developer would be ready to be added to the station sump.

The various developer formulations as well as a comparative example are set forth in Table 2 below:

TABLE 2

| Component | Supplier | Trade Name | Comparative Example 1 | Example 2 | Example 3 | Example 4 |
|---|---|---|---|---|---|---|
| Toner formulation | | | | | | |
| Crosslinked styrene acrylate copolymer | Eastman Kodak | | 92% | 90% | 90% | 90% |
| carbon black | Cabot Corp. | | 6.5% | 6.3% | 6.3% | 6.3% |
| organo iron complex charge anent | Hodagaya | | 1.4% | 1.8% | 1.8% | 1.8% |
| polyethylene wax | Clariant Chemical | | none | 1.8% | 1.8% | 1.8% |
| silica surface treatment | Degussa | | none | 0.2% | 0.2% | 0.2% |
| Developer formulation | | | | | | |
| stronitium ferrite particles | Powdertech | | 98.5% | 98.5% | 99% | 99% |
| polymeric carrier coating: | | | | | | |
| Silicone type resin | Powdertech | | 1.5% | none | none | |
| 80/20 wt % blend of polyvinylidiene/poly methylmethacrylate | | | none | 1.5% | none | |
| 60/40 wt % blend of polyvinylidiene/poly methylmethacrylate | | | none | none | none | 2% |
| 50/50 wt % blend of polyvinylidiene/poly methylmethacrylate | | | none | none | 1% | |
| toner concentration | | | 10% | 10% | 10% | |

The toner of the present application was then added to form a developer formulation. Carriers are prepared from uncoated $SrFe_{12}O_{19}$ core from Powdertech Corporation of Valparaiso, Inc. The material is prepared via a spray drying process as described in U.S. Pat. No. 6,228,549, incorporated in its entirety by references herein. The volume median is 25-30 microns.

The dry powder coatings of Kynar/poly(methylmethacryate) were prepared from KYNAR 301F from Elf Atochem North America and poly(methylmethacryate) MP 1201 manufactured by Soken. The appropriate amount of each dry powder was weighed and added to the uncoated core. The ferrite/polymer mixture was roll milled for 15 minutes; sieved to remove any unbroken agglomerates, and then rolled another 15 minutes. The mixture was loaded into dishes or trays for curing. The curing was done by either introducing the material into a hot oven, or by ramping a cool oven to the dwell temperature, followed by a cool-down step. The cure temperature ranged from 190-250° C. for 1-3 hours. After curing, the carrier was deagglomerated by sieving through a 230 mesh screen.

The silicone resins coatings were provided by Powdertech from a methylsilsesquioxane resin application using an ammonium-based catalyst as described in U.S. Pat. No. 6,124,068, incorporated in its entirety by reference herein.

Developers were prepared by combining the carrier and toner in the appropriate weight percent ratio. Normally, a developer load was made by mixing 2 kgs of material in a 1 gallon metal can by agitation on a paint shaker for 1-15 minutes. The mixed developer was magnetized on a RFL 595 High Power Magnetreator/Charger at a setting of 400

Evaluation:

FIGS. 1-8 illustrate the improved charge to mass stability with respect to variations in temperature and humidity environmental conditions and the improved charge to mass stability over time as the toners and developers. The charge to mass measurement was done by the MECCA method. Printer testing was done on a Heidelberg Digimaster printer or a prototype LTD device.

Figure 4:
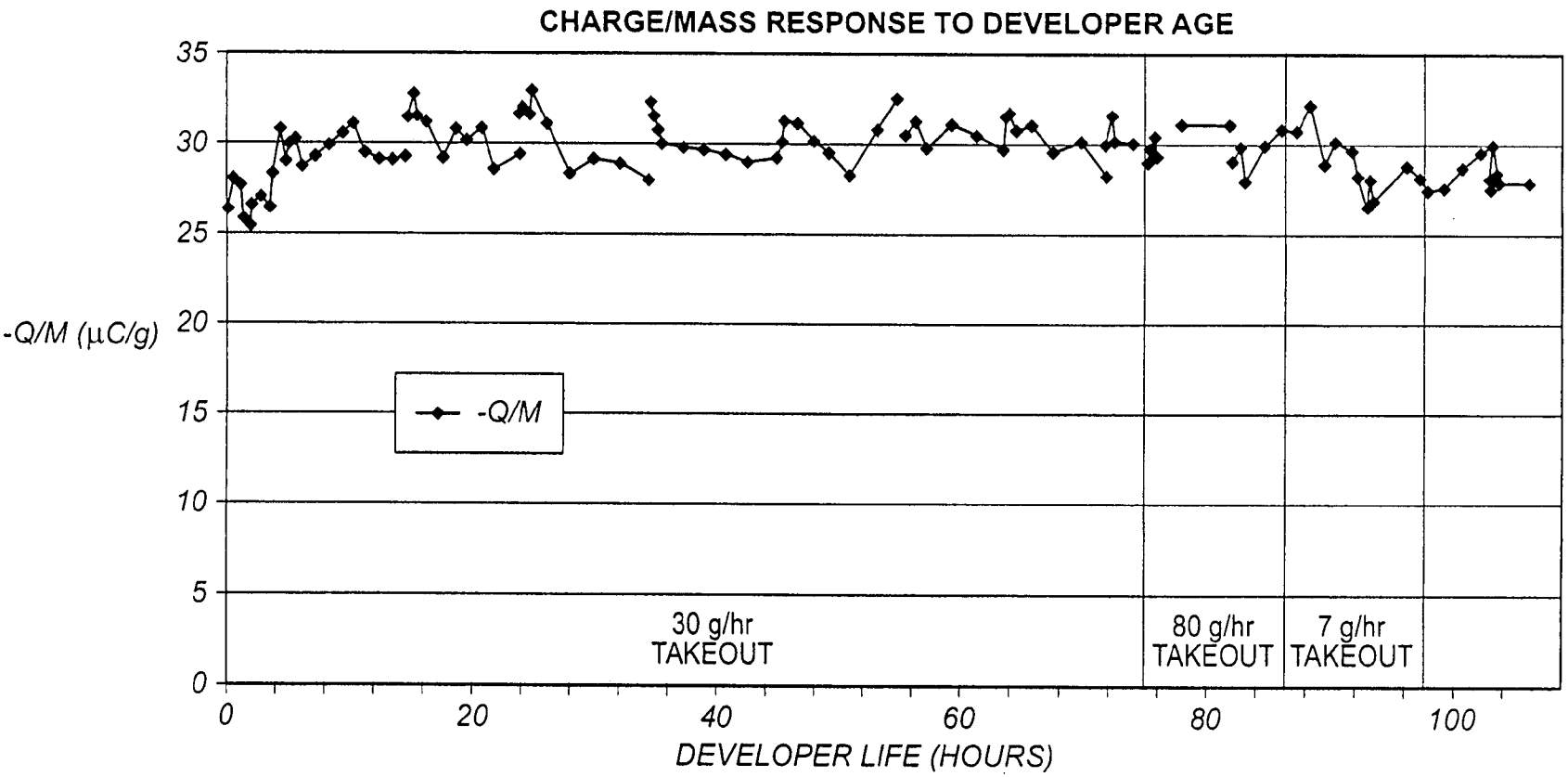
FIG. 4 is a graph showing a charge to mass response as a function of developer age for a toner of the present invention.
Figure 5:
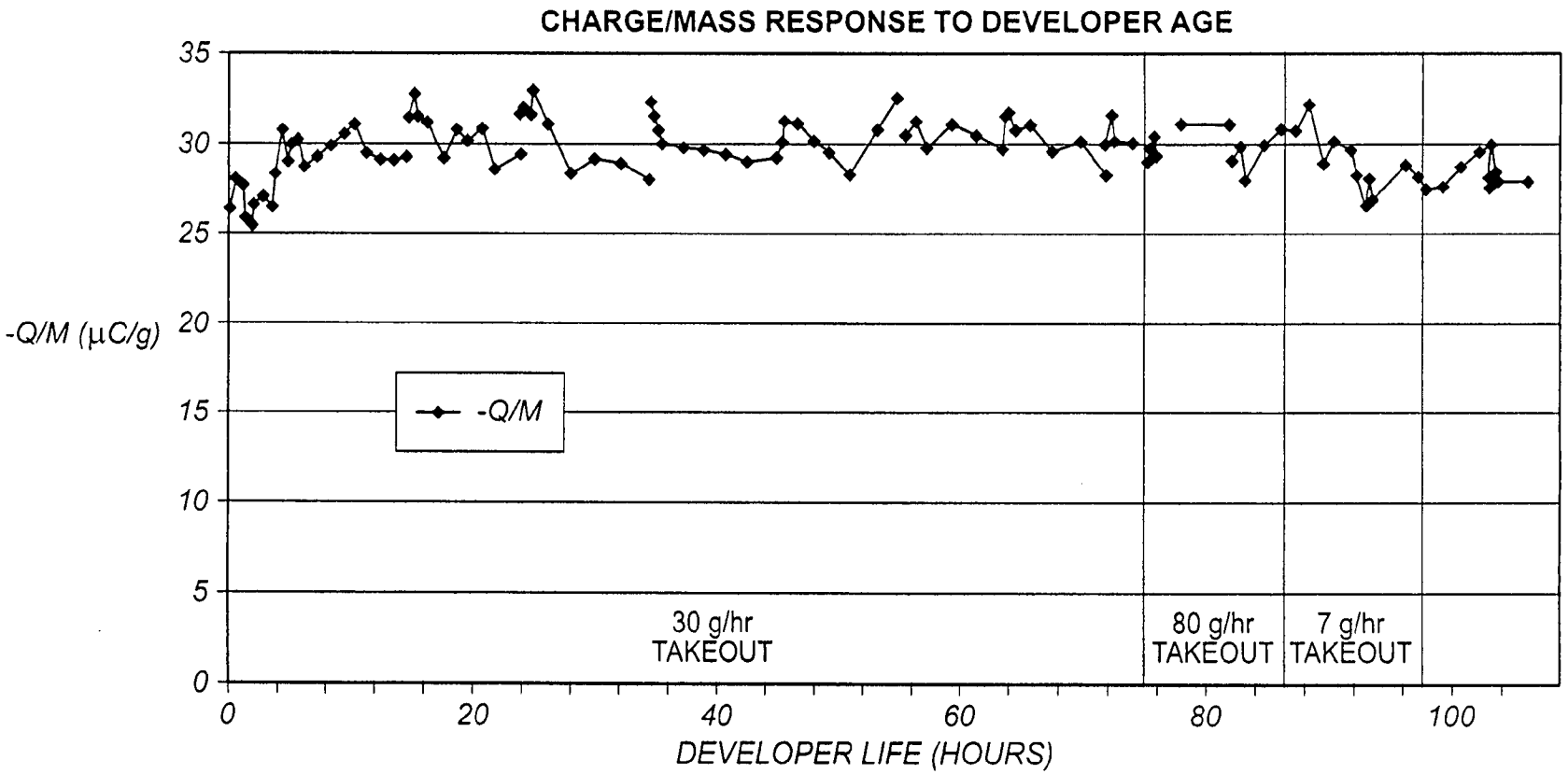
FIG. 5 is a graph showing a charge to mass response as a function of developer age for another toner of the present invention.
Figure 6:
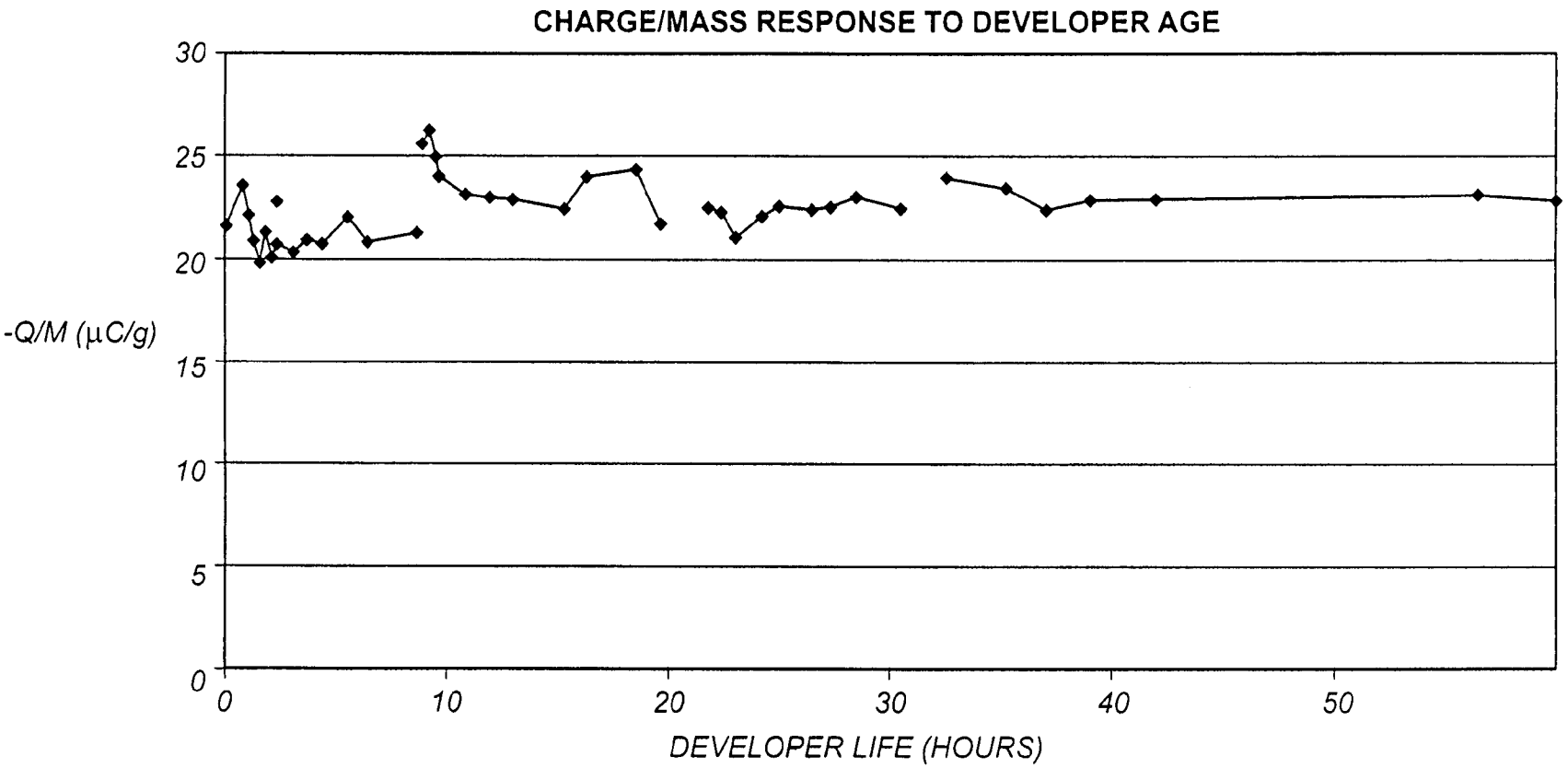
FIG. 6 is a graph showing a charge to mass response as a function of developer age for another toner of the present invention.
Figure 7:
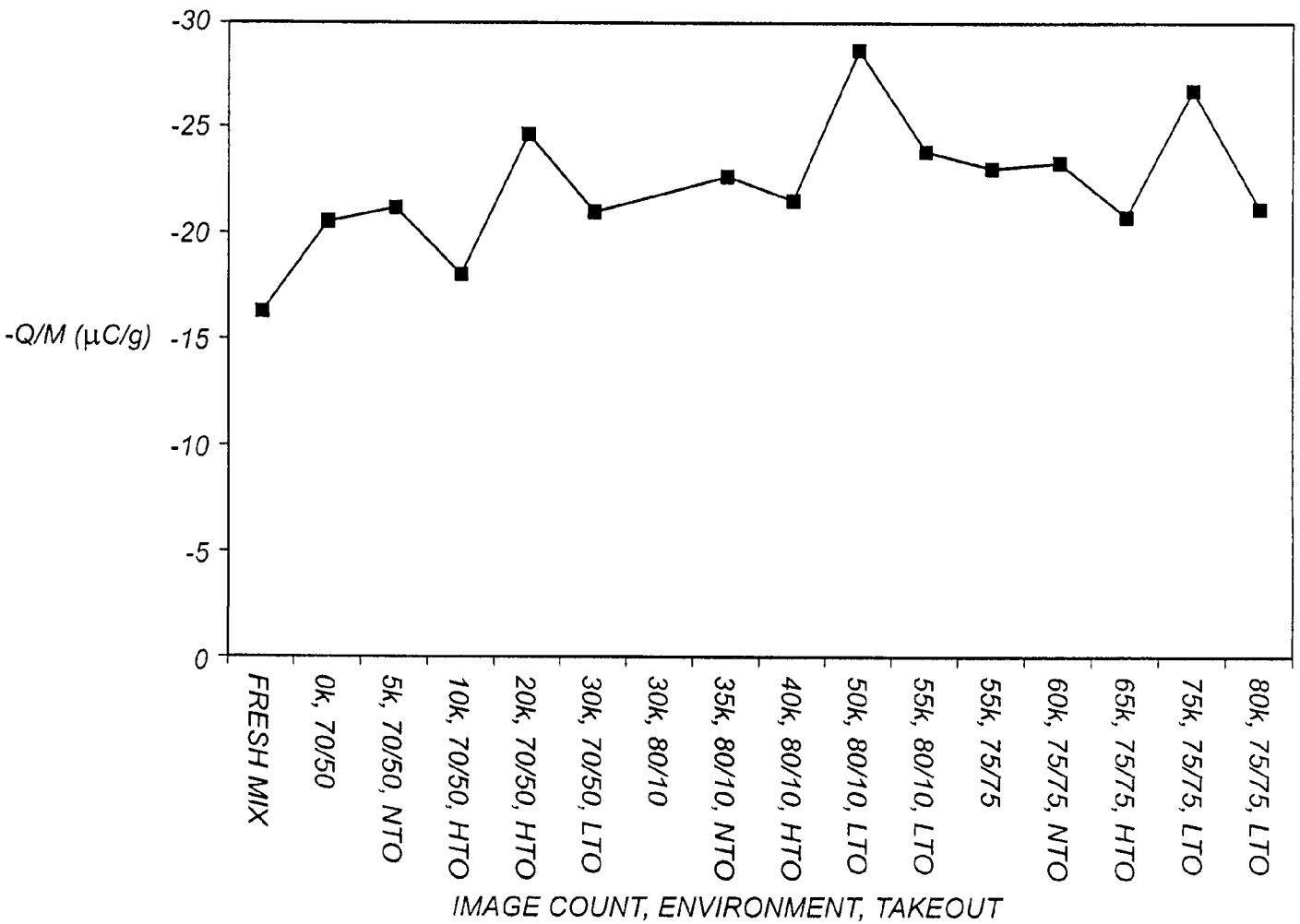
FIG. 7 is a graph showing a charge to mass variation in printer temperature and relative humidity as a function of image count for a control toner.

The results were as follows:

In the examples, the developer age that is recorded in some of the figures reflects the number of hours that the developer was used in a copier. In FIGS. 4 and 5, the amount of "take out" set forth at the bottom of each graph reflects the amount of developer used during the use of the developer. For instance, 30 g/hr of developer take out reflects the amount of developer used per hour in copying. Thus, 80 g/hr would be a high amount of developer used reflecting large segments of text that is being copied from an original while 7 g/hr reflects a low amount of text present on an original that is being copied. In FIG. 7, on the X axis, the first set of numbers (e.g., 0 k, 5 k etc.) reflects the number of images copied during the test. The second series of numbers, for instance 70/50 represents the temperature in degrees C. while the second number reflects relative humidity. Thus, 70/50 would represent 70° C. with a relative humidity of 50%. The last information on the X axis reflects the amount of toner use occurring during the series of copying. For instance, NTO would represent a normal use of developer while HTO would represent a high amount of developer used and LTO would represent a low amount of developer used. MH represents a medium/high amount of developer used during the copying period.

Figure 2:
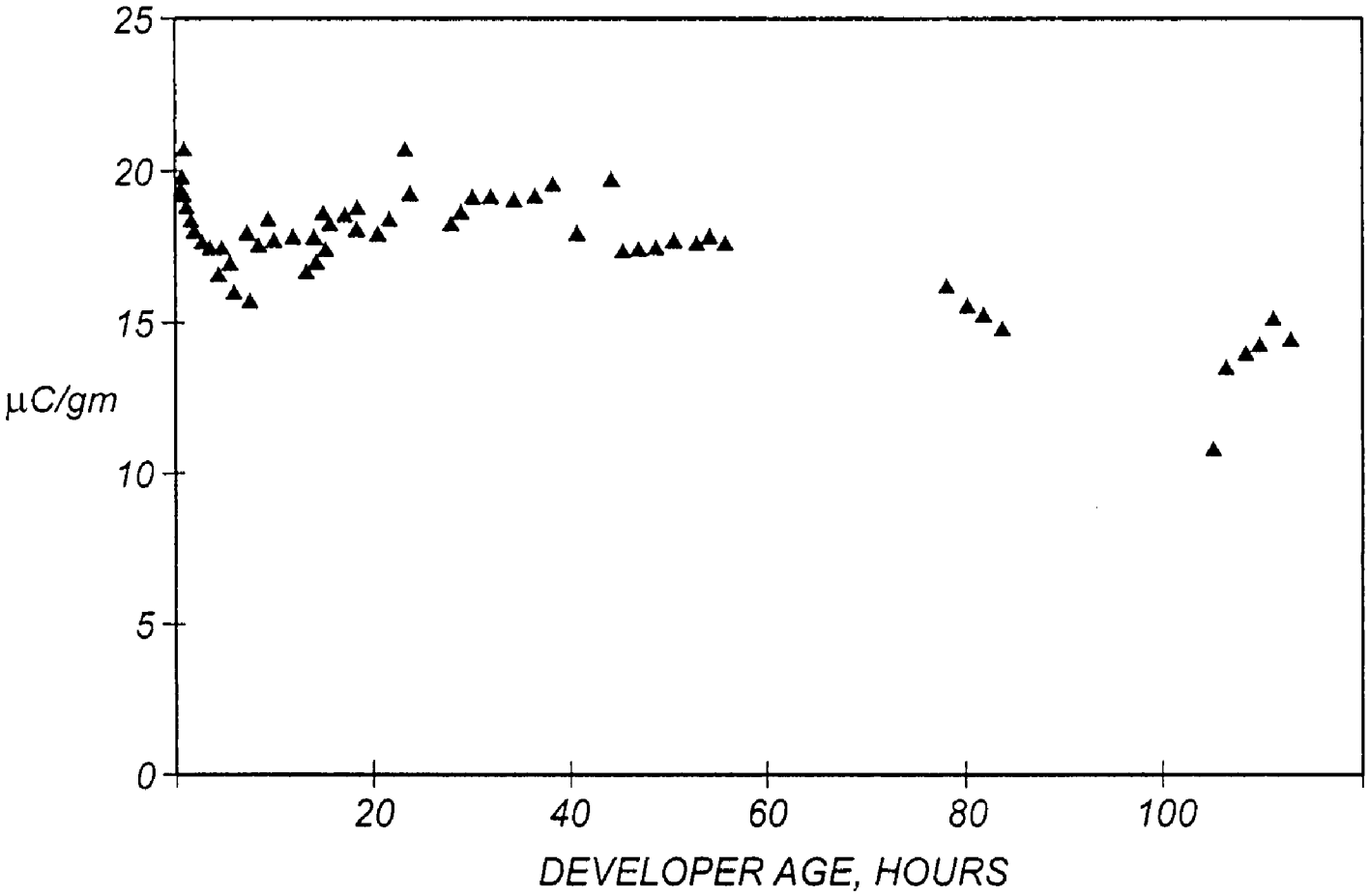
FIG. 2 is a graph showing charge to mass response as a function of developer operating time or use time for a control toner.

FIG. 1 shows the charge to mass response as a result of humidity changes at four different developer ages for the comparative example. "New" developer, 0 hours, showed a decrease in charge/mass level as the humidity increased. "Aged" developers showed an increase in charge after 20, 50 and 130 hours of operation in an LTD system of approximately 10 uC/gm. FIG. 2 shows that the charge to mass level also decreased as the developer was operated in an LTD system. Also, the charge level decayed from −20 uC/gm to −15 over 100 hours of use.

Figure 3:
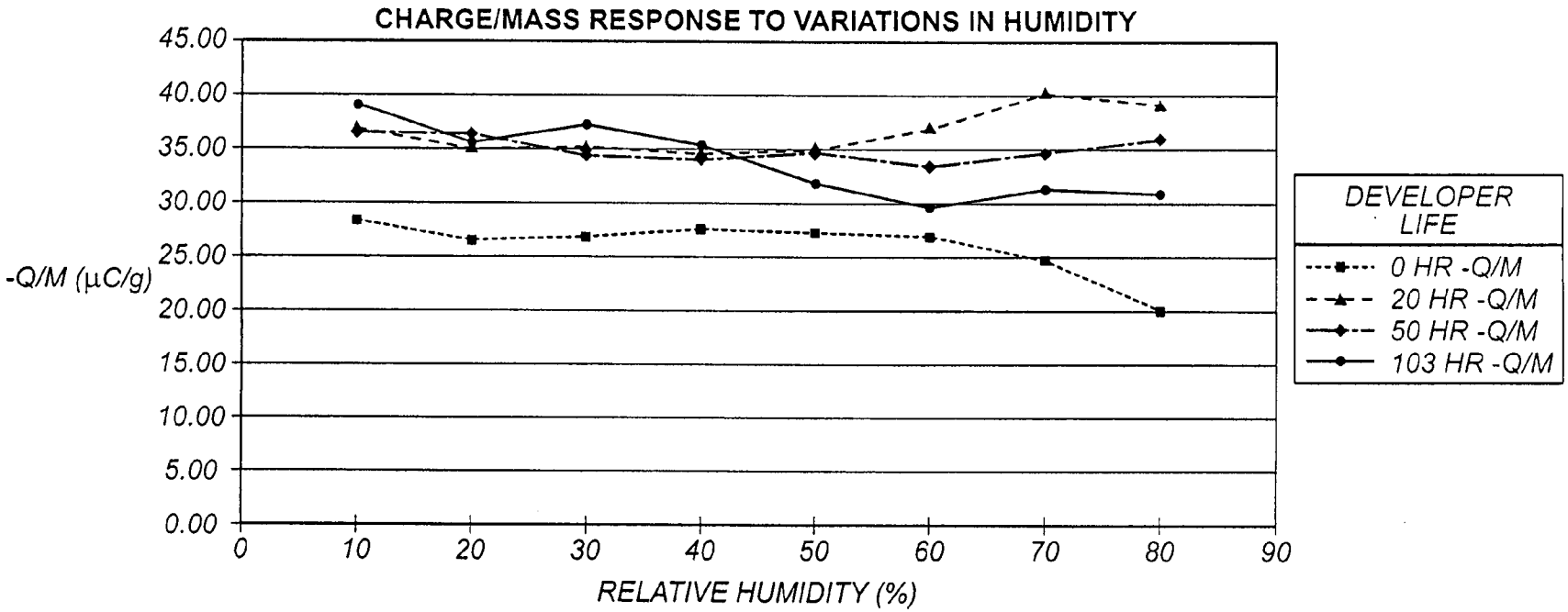
FIG. 3 is a graph showing charge to mass response as a function of relative humidity for a toner of the present invention.
Figure 8:
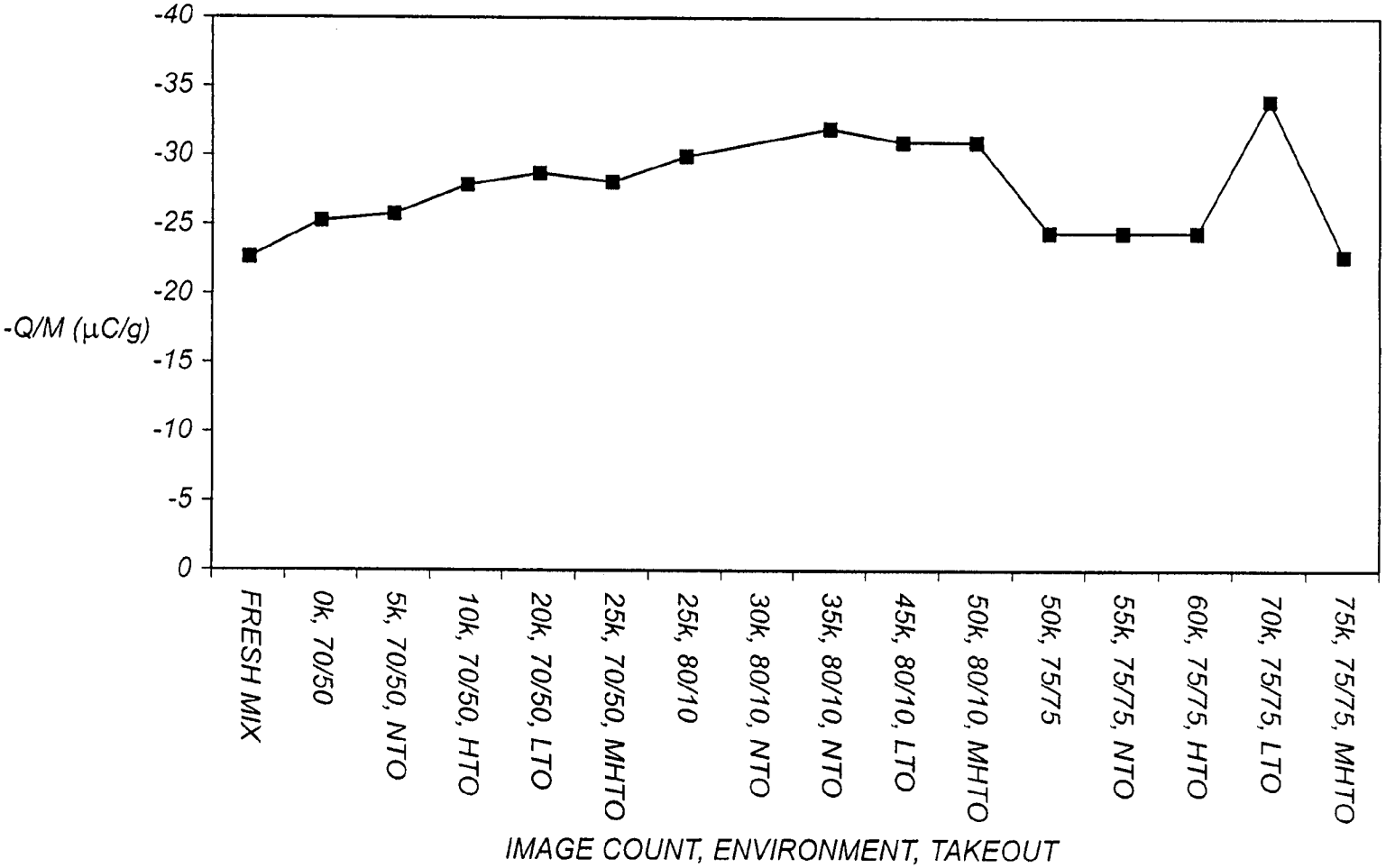
FIG. 8 is a graph showing a charge to mass response for variations in printer temperature or relative humidity as a function of image count for a toner of the present invention.

FIG. 3 shows the charge to mass response of Example 4 to humidity variations. Measurements at 20, 50, and 100 hours of use showed less that 5 uC/gm change, less than Comparative Example 1. FIG. 4 showed that the developer does not change charge level as it is operated in an LTD system and the charge level did not decay as in Comparative Example 1. FIG. 5 showed that the developer from Example 3 has a steady consistent charge/mass response over the developer life even with respect to variations in the amount of developer used in forming images. As can be seen at the bottom of FIG. 5, the amount of text present on the original that was being copied was varied 3 separate times in order to ensure that the toner/mass response was unaffected by such activity. As can be seen, the toners of the present invention were quite consistent in the charge/mass response with these various factors being altered. Similarly, in FIG. 6, the toner of example 2 was tested with respect to the charge/mass response over the developer life. Again, a very consistent charge level was maintained over the developer life which showed the effectiveness of the toner/developer of the present invention. FIGS. 7 and 8 compare this toner developer to the Comparative Example 1 in a Digimaster printer. Charge to mass was measured as the temperature, humidity, and toner coverage of documents printer were varied. The variations in charge of mass as printer conditions were changed was less for the toner of Example 4.

The toner/developer of Example 3 was tested in an LTD for charge to mass stability and the results are shown in FIG. 5. As can be seen, the response was less variation than in Comparative Example 1.

TABLE 3

| | Q/m, μC/gm | | Chargeratio |
|---|---|---|---|
| Example | 2 minutes | 10 minutes | 2'Q/m /10'Q/m |
| 1 | −17 | −28 | 0.61 |
| 2 | −26 | −23 | 1.13 |
| 3 | −28 | −26 | 1.08 |
| 4 | −24 | −22 | 1.09 |

In Table 3, the charge for 2 minutes and 10 minutes is shown for each of the examples using the MECCA test referred to above. Also, the 2'/10' charge rating is also set forth. As can be seen, the superior toners/developers of the present invention had a 2'/10' charge ratio close to 1, while the conventional toner had a charge ratio well below 1.

Other embodiments of the present invention will be apparent to those skilled in the art from consideration of the present specification and practice of the present invention disclosed herein. It is intended that the present specification and examples be considered as exemplary only with a true scope and spirit of the invention being indicated by the following claims and equivalents thereof.

What is claimed is:

1. Toner particles comprising at least one toner resin, at least one charge control agent, at least one surface treatment agent, and optionally at least one release agent or colorant or both, wherein inorganic particles are present in said toner resin and said surface treatment agent is present on the surface of said toner particles, wherein said toner resin comprises a cross-linked styrene acrylate copolymer, said charge control agent comprises an organo iron complex charge agent, said surface treatment agent comprises silica, and said inorganic particles comprise silica, and wherein the toner particles having a charge rate such that the 2'/10' MECCA charge ratio is from about 0.9 to about 1.1, and having a 2 minute charge level of from −20 to about −30 μC/g.

2. The toner particles of claim 1, wherein said toner resin is prepared by a limited coalescence reaction.

3. A developer comprising the toner particles of claim 2 and magnetic carrier particles.

4. The toner particles of claim 1, wherein said inorganic particles comprise colloidal silica.

5. The toner particles of claim 1, wherein said toner resin comprises from about 80 wt % to about 95 wt % cross-linked styrene acrylate copolymer, said charge control agent comprises from about 1 wt % to about 2.5 wt % of organo iron complex charge agent, said surface treatment agent comprises from about 0.05 wt % to about 5.0 wt % of silica, and said inorganic particles comprise from about 0.1 wt % to about 0.5 wt % silica, based on the weight of the toner particles.

6. The toner particles of claim 5, wherein said toner resin is prepared by a limited coalescence reaction, and said release agent is present and comprises from about 0.1 wt % to about 10 wt % of polyethylene wax based on the weight of the toner particles.

7. A developer comprising the toner particles of claim 6 and magnetic carrier particles.

8. A developer comprising the toner particles of claim 5 and magnetic carrier particles.

9. A developer comprising the toner particles of claim 1 and magnetic carrier particles.

10. The developer of claim 9, wherein said magnetic carrier particles comprise ferrite particles.

11. The developer of claim 9, wherein said magnetic carrier particles comprise strontium ferrite particles.

12. The developer of claim 9, wherein said magnetic carrier particles comprise strontium ferrite particles coated with a polymeric coating.

13. The developer of claim 12, wherein said polymeric coating comprises a blend of polyvinylidiene/polymethylmethacrylate polymer.

14. The developer of claim 13, wherein said blend is present in a blend weight ratio of from 80/20 wt % blend of polyvinylidiene/polymethylmethacrylate polymer to about 50/50 wt %.

15. Toner particles comprising at least one toner resin, at least one charge control agent, at least one surface treatment agent, and optionally at least one release agent or colorant or both, wherein inorganic particles are present in said toner resin and said surface treatment agent is present on the surface of said toner particles, wherein said inorganic particles are colloidal silica particles that are not in a charged state and are present in an amount of from about 0.1 weight % to about 0.5 weight %, based on the weight of the toner particles, and wherein said toner particles having a charge rate such that the 2'/10' MECCA charge ratio is from about 0.9 to about 1.1, and having a 2 minute charge level of from −20 to about −30 μC/g.

16. The toner particles of claim 15, wherein said surface treatment agent comprises silica.

17. A developer comprising the toner particles of claim 16 and magnetic carrier particles.

18. The toner particles of claim 15, wherein said toner resin is a cross-linked styrene acrylate copolymer.

19. A developer comprising the toner particles of claim 18 and magnetic carrier particles.

20. The toner particles of claim 15, wherein said charge control agent is an organo iron complex charge agent.

21. The toner particles of claim 15, wherein said release agent is present and comprises a polyethylene wax.

22. The toner particles of claim 15, wherein said toner resin is prepared by a limited coalescence reaction.

23. A developer comprising the toner particles of claim 22 and magnetic earner particles.

24. The toner particles of claim 15, wherein said toner resin comprises a cross-linked styrene acrylate copolymer, said charge control agent is an organo iron complex charge agent, said surface treatment agent comprises silica, said toner resin is prepared by a limited coalescence reaction, and said release agent is present and comprises a polyethylene wax.

25. A developer comprising the toner particles of claim 24 and magnetic carrier particles.

26. The toner particles of claim 15, wherein said toner resin comprises about 90 wt % cross-linked styrene acrylate copolymer, said charge control agent comprises about 1.8 wt % of organo iron complex charge agent, said surface treatment agent comprises from about 0.2 to about 0.6 wt % of silica, and said colloidal silica particles are present from about 0.2 wt % to about 0.3 wt %, based on the weight of the toner particles.

27. The toner particles of claim 26, wherein said toner resin is prepared by a limited coalescence reaction, and said release agent is present and comprises about 1.8 wt % of polyethylene wax based on the weight of the toner particles.

28. A developer comprising the toner particles of claim 27 and magnetic carrier particles.

29. A developer comprising the toner particles of claim 26 and magnetic carrier particles.

30. A developer comprising the toner particles of claim 15 and magnetic carrier particles.

31. The toner particles of claim 15, wherein said charge control agent is a negative charge control agent.

* * * * *